US005462042A

United States Patent [19]

Greenwell

[11] Patent Number: 5,462,042

[45] Date of Patent: Oct. 31, 1995

[54] SEMIAUTOMATIC PAINT BALL GUN

[76] Inventor: Andrew J. Greenwell, 1481 Hillside Pl., Yuma, Ariz. 85364

[21] Appl. No.: 142,921

[22] Filed: Oct. 29, 1993

[51] Int. Cl.[6] ..... F41B 11/32

[52] U.S. Cl. ..... 124/76; 124/71; 124/56; 124/73

[58] Field of Search ..... 124/73, 74, 76, 124/72, 71, 69, 70, 56, 47, 49, 50, 45

[56] References Cited

U.S. PATENT DOCUMENTS

| | | | |
|---|---|---|---|
| 2,817,328 | 12/1957 | Gale | 124/76 X |
| 3,000,371 | 9/1961 | Hyde | 124/74 X |
| 3,177,863 | 4/1965 | Spack | 124/74 X |
| 3,199,501 | 8/1965 | Bertschinger . | |
| 3,680,540 | 8/1972 | Stengl | 124/50 X |
| 3,788,298 | 1/1974 | Hale . | |
| 4,531,503 | 7/1985 | Shepherd . | |
| 4,602,608 | 7/1986 | Lacam et al. | 124/74 |
| 4,819,610 | 4/1989 | Lacam et al. | 124/74 X |
| 4,936,282 | 6/1990 | Dobbins et al. . | |
| 5,054,464 | 10/1991 | Young . | |
| 5,063,905 | 11/1991 | Farrell . | |
| 5,165,383 | 11/1992 | Ebert et al. | 124/74 |

*Primary Examiner*—Anthony Knight
*Attorney, Agent, or Firm*—Jacobson, Price, Holman & Stern

[57] ABSTRACT

A $CO_2$ powered paint ball gun is provided operative to three times expand $CO_2$ gas as it is extracted from a container of liquid $CO_2$ and ducted to a position behind a paint ball disposed in the barrel of said gun. The gun includes three adjustments by which the velocity of the discharge of a paint ball from the barrel of the gun may be adjusted and includes a bolt action which is gas operated. Furthermore, the gun components may be readily disassembled for cleaning and/or repair and replacement and the initial expansion of $CO_2$ gas under pressure occurs in a passage passing through the hand grip of the gun in a manner such that the chilled first expanded $CO_2$ gas may be warmed by the heat of the user's hand grasping the hand grip.

21 Claims, 4 Drawing Sheets

SEMIAUTOMATIC PAINT BALL GUN

BACKGROUND OF THE INVENTION

1. Field of the Invention

This invention relates to a gas powered semiautomatic gun designed specifically to successively fire a plurality of paint balls and is constructed to be operable in a semiautomatic manner through gas operation.

2. Description of Related Art

Various different forms of gas operated guns including some of the general structural and operational features of the instant invention heretofore have been known. Examples of these different forms of gas operated guns are disclosed in U.S. Pat. Nos. 3,199,501, 4,531,503, 4,936,282, 5,054,464 and 5,063,905. However, these previously known devices do not include several combinations of interacting components of the gun of the instant invention which result in advantages of operation.

SUMMARY OF THE INVENTION

The semiautomatic paint ball gun of the instant invention is designed to successively three times expand the gas charge from the reservoir thereof during the process of firing the gun. In this manner, the propelling gas is twice expanded prior to being expanded in the process of projecting a paint ball from the barrel of the gun and the loss of total energy from the reservoir of the compressed gas due to the absorption of heat during three stages of expansion rather than one or two stages of expansion is maintained at a minimum to thereby allow a greater number of projectiles to be fired with a given amount of gas under pressure, as long as the gun is not rapidly fired throughout depletion of a full charge of pressurized gas from the gas reservoir thereof.

In addition, the gun is rendered semiautomatic by the utilization of some of the gas pressure from each firing of the gun for cocking the bolt of the gun and several different adjustments may be made to the gun in order to adjust the muzzle velocity thereof.

Further, the gun is constructed with an upwardly and outwardly inclined gravity feed magazine by which successive paint balls may be received within the rear of the barrel assembly of the gun preparatory to the gun being fired and the upward and outward inclination of the gravity feed magazine provides sufficient clearance for a centered over the barrel gun sight.

Further, the magazine is constructed such that it is removably mounted from the gun and is reversible in a front to rear manner to thereby enable the magazine to open upwardly and outwardly to either side of the gun, thus making the gun readily adaptable for right or left handed use.

Finally, the bolt of the gun which defines the third chamber for the expansion of propelling gas therein is back bored generally one-half of an inch and it has been found that this back boring, while utilizing somewhat more propellent gas, results in an increase in the muzzle velocity of the projectile fired from the gun.

The main object of this invention is to provide a $CO_2$ powered gun of the automatic gas operated type and which utilizes a gas delivery system for delivering gas under pressure from the gas reservoir to the interior of the bolt immediately behind the projectile in a manner such that the gas is expanded three times in succession for each firing of the gun.

Another important object of this invention is to provide a gas operated gun wherein at least two different structures are provided for adjusting the muzzle velocity of a projectile to be fired from the gun given a gas supply at a predetermined pressure.

Another very important object of this invention is to provide a trigger and seer assembly for the gun which may be quickly and totally disassembled from the frame of the gun for cleaning and/or repair operations.

A final object of this invention to be specifically enumerated herein is to provide a $CO_2$ powered paint ball gun in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
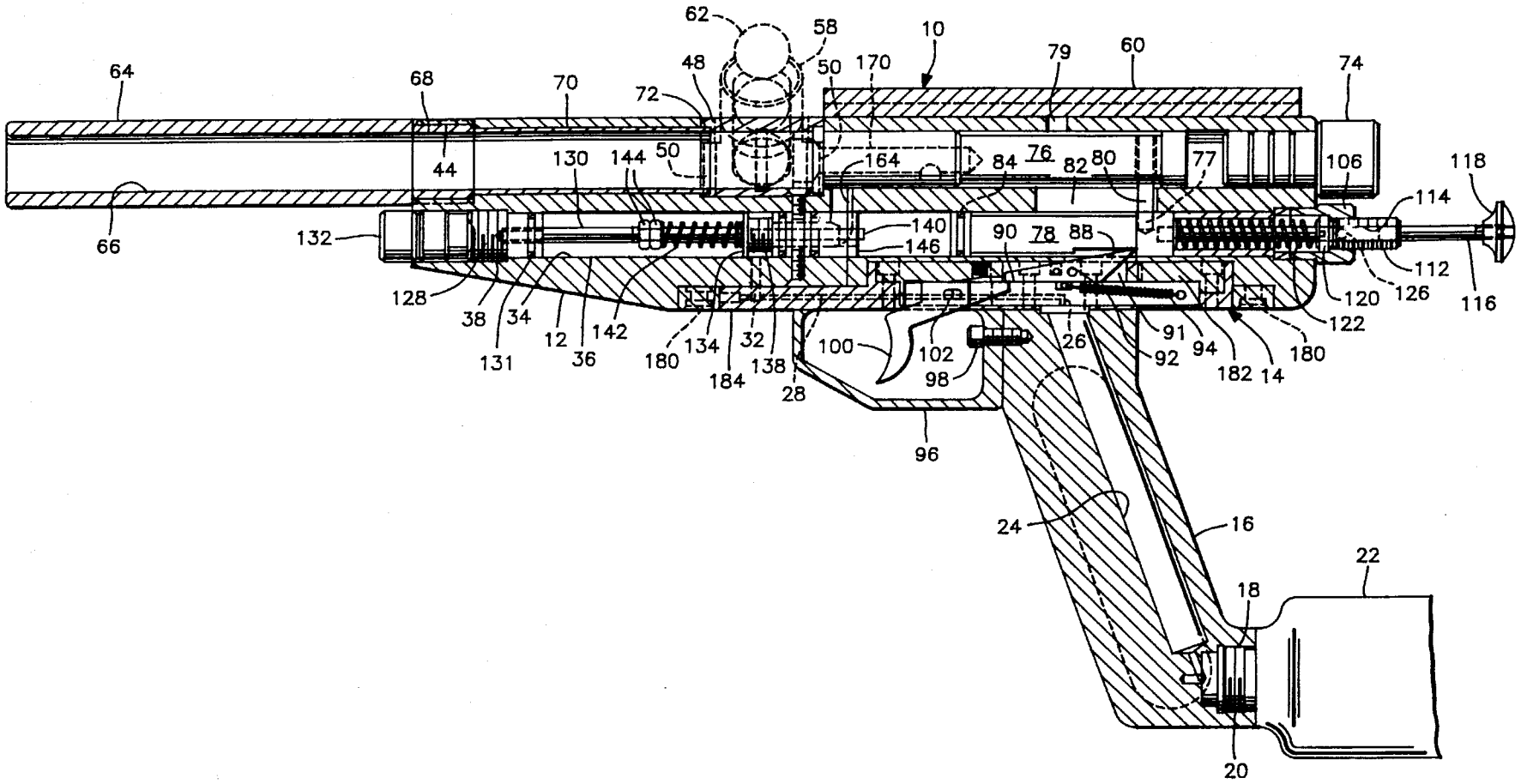
FIG. 1 is a longitudinal vertical sectional view of the gun with the bolt and hammer in rearwardly retracted positions and the upwardly and outwardly inclined throat of the magazine and associated paint balls being illustrated in phantom lines.
Figure 2:
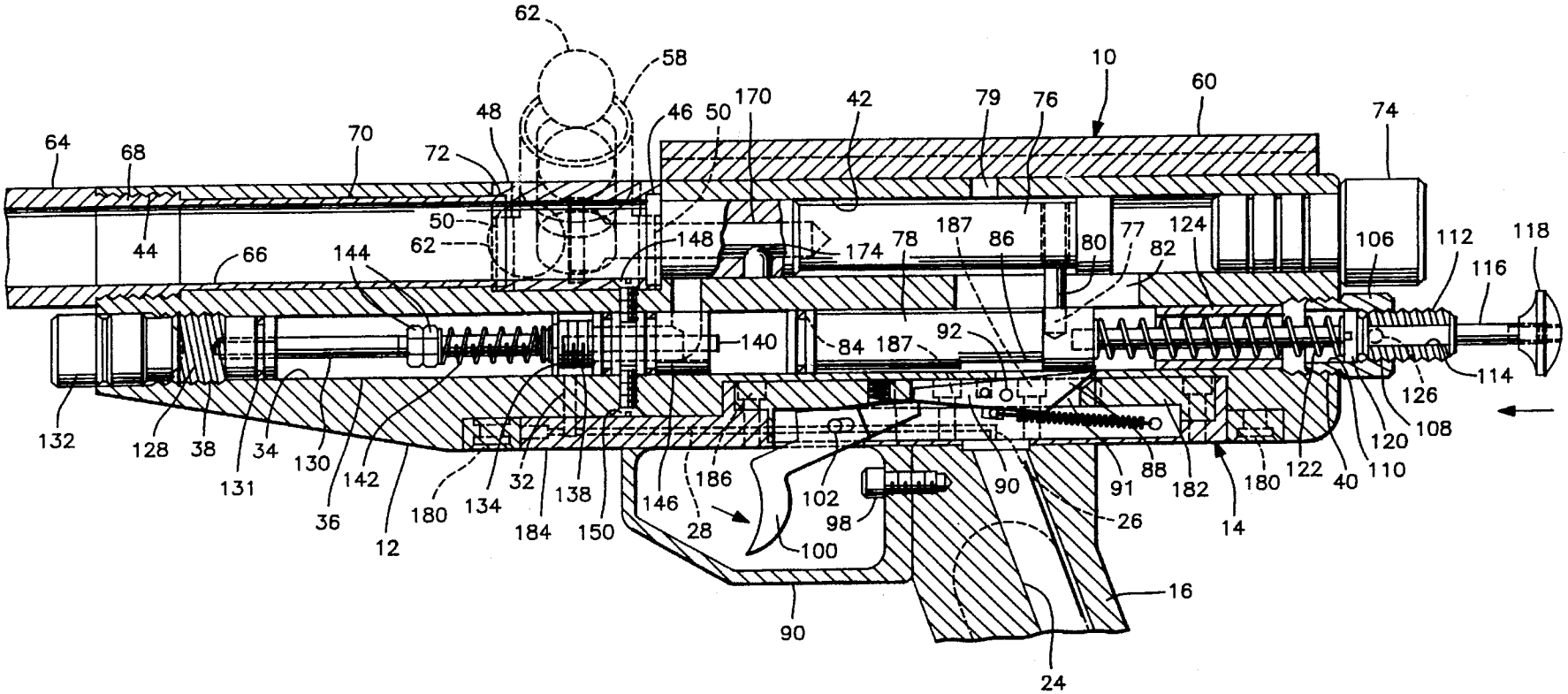
FIG. 2 is an enlarged fragmentary vertical sectional view of the rear portion of the gun illustrated in FIG. 1 and with the trigger illustrated in a rearwardly pulled position and the associated sear pivoted to the release position to allow the bolt and hammer to move partially forward.

Referring now more specifically to FIGS. 1 and 2, the paint ball gun of the instant invention is referred to in general by the reference numeral 10 and includes a main body or frame 12 from the underside of which a trigger mechanism and trigger guard assembly referred to in general by the reference numeral 14 is removably supported, the assembly 14 removably supporting a depending hand grip 16 therefrom. The lower end of the hand grip 16 includes a rearwardly opening threaded cavity into which the neck 20 of a $CO_2$ cartridge 22 may be removably threaded, the closure closing the neck 20 of the cartridge 22 automatically being opened upon threaded engagement of the cartridge 22 into the chamber 18.

The hand grip 16 defines a first longitudinally extending expansion chamber 24 extending therethrough and opening upwardly into the inlet end 26 of a horizontal transfer passage 28 extending longitudinally through the assembly 14. The outlet end 30 of the transfer passage 28 opens into a second transfer passage 32 including aligned inlet and outlet ends formed in the assembly 14 and the body or frame 12 and opening upwardly into a second longitudinally extending expansion chamber 34 defined by a longitudinal bore 36 formed through a lower portion of the body or frame 12 and including a threaded counterbore 38 at its front end and a threaded counterbore 40 at its rear end, the counterbores 38 and 40 opening through the front and rear ends of the body or frame 12.

The upper portion of the body or frame 12 has an upper longitudinal bore 42 formed therethrough opening rearwardly through the rear end of the body 12 and forwardly through the forward end of the body 12, the forward end of the bore 42 including a threaded counterbore 44.

In addition, the upper portion of the body 12 has an upwardly opening notch 46 formed therein whose forward extremity is disposed approximately one-third rearwardly along the bore 42 from the forward end thereof. The notch 46 removably receives a gravity feed magazine 48 formed therein and the magazine is removably secured within the notch 46 and to the body 12 through the utilization of four upwardly removable threaded fasteners 50.

Figure 3:
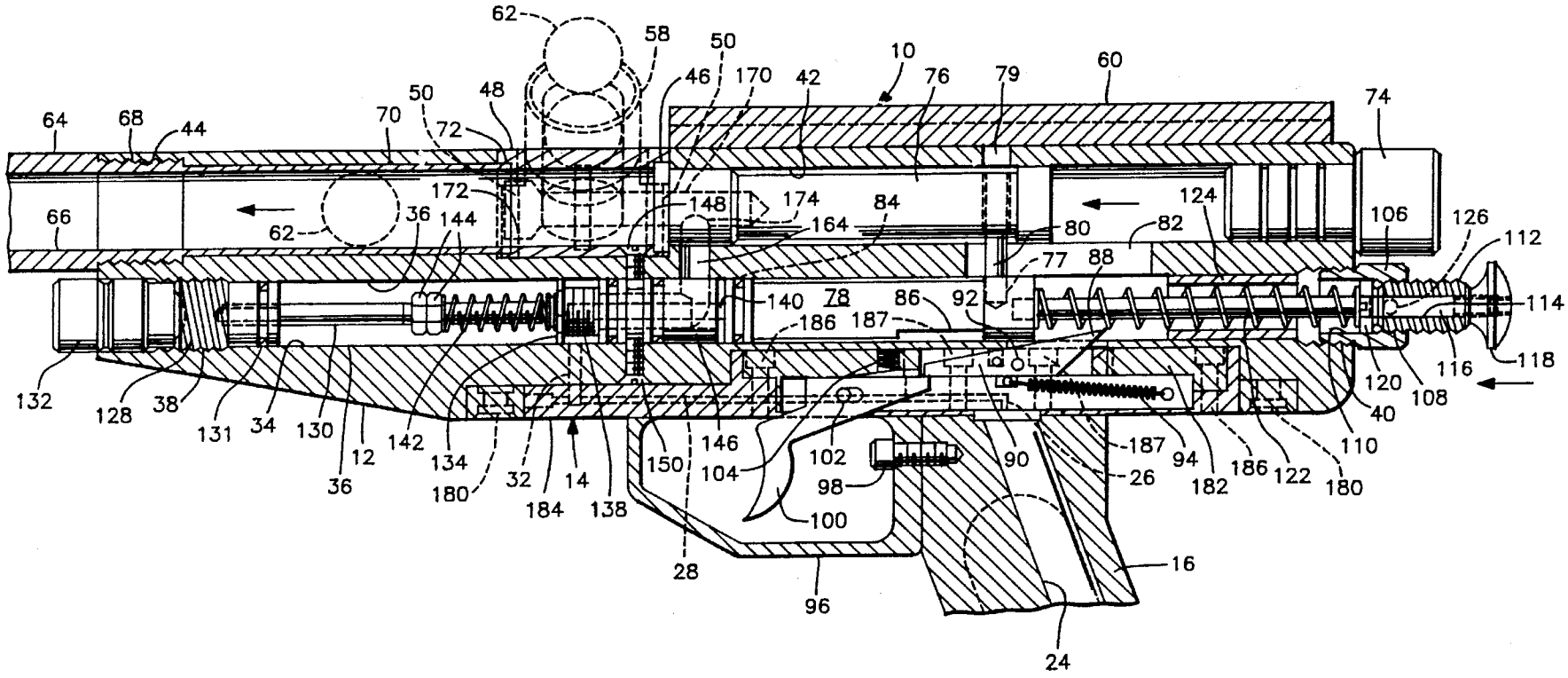
FIG. 3 is an enlarged fragmentary longitudinal vertical sectional view similar to FIG. 2 but illustrating the bolt and hammer in their forwardly displaced positions immediately subsequent to contact of the hammer with the cup rod and return of the cup rod to its rest position.
Figure 6:
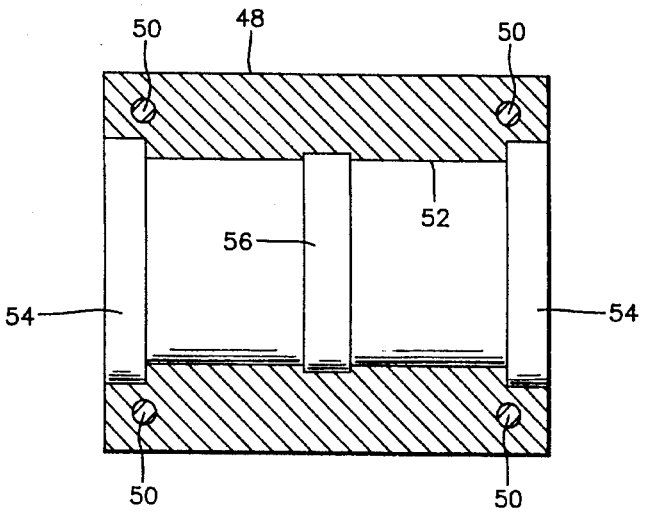
FIG. 6 is an enlarged horizontal sectional view of the rear barrel extension comprising the lower portion of the magazine illustrating the central circumferential interior land therein for maintaining a paint ball within the bore rear extension in proper position and further illustrating the opposite end counterbores in which the rear threaded end of the barrel is received when the magazine is in reversed positions.

The lower portion of the magazine 48 has a smooth bore 52 formed therethrough, see FIGS. 3 and 6, and the opposite ends of the bore 52 include counterbores 54 while the longitudinal center of the bore 52 includes a circumferentially extending diametrically enlarged land 56. The upper portion of the magazine 48 defines an upwardly and outwardly inclined inlet tube 58 which opens upwardly and outwardly to one side of the body in a manner such as to not block sighting along a removable sight rib 60 supported and projecting upwardly from and extending along the rear portion of the upper side of the body 12.

The magazine 48 is reversibly receivable within the notch 46 such that either counterbore 54 will be disposed forwardmost and the inlet tube 58 may be inclined upwardly and outwardly to either side of the body 12, the land 56 being aligned with the longitudinal center of the inclined inlet tube 56 in a manner such that when a paint ball 62 is dropped downwardly through the upper open end of the inlet tube 58 it will automatically position itself with its lower and opposite side peripheral portions seated in the land 56.

The gun 10 includes a forward barrel 64 having a longitudinal bore 66 therethrough and the rear longitudinal central portion of the barrel 64 includes an externally threaded first diametrically reduced portion 68 removably threaded in the counterbore 44, the rear terminal end 72 of the barrel 64 being further reduced and removably received in a counterbore of slightly smaller diameter than the counterbore 44 and larger in diameter than the bore 42, the bore 66 being of the same diameter of the bore 42 and the bore 52. The rear terminal end 72 of the barrel 64 is removably seated within whichever counterbore 54 of the magazine 48 is disposed forwardmost. Therefore, in order to remove the magazine 48 for the purpose of cleaning the same or reversing it in position, the threaded diametrically reduced portion 68 of the barrel 64 must be partially threaded out of the counterbore 44 in order to forwardly retract the rear terminal end 72 of the barrel 64 forwardly of the forwardmost counterbore 54.

As may be readily understood, the bore 52 of the magazine 48 actually comprises a rearward extension of the bore 66 and, accordingly, the magazine 48 comprises a part of the overall barrel assembly including barrel 64.

The rear end of the bore 42 is closed by a removable O-ring equipped plug 74 and a generally cylindrical bolt 76 is slidable in the bore 42 forward of the plug 74, the rear portion of the bolt 76 being coupled to the rear portion of a generally cylindrical hammer 78 slidable in the bore 34 through the utilization of a vertical connecting pin 80 slidable through an elongated slot 82 formed in the body or frame 12 and communicating the bores 42 and 34 and with the forward end of the hammer 78 being equipped with an O-ring 84, the pin 80 being threadedly mounted from the bolt 76, snugly received in a blind bore 77 formed in the bolt 76 and upwardly removable through a bore 79 formed in the rear upper portion of the body 12 once the sight rib 60 has been removed. Also, the underside of the rear end of the hammer 78 includes a notch 86 therein in which the rear end 88 of a pivoted sear or cam 90 is receivable, the sear 90 being pivoted from a slide 91 as at 92 and under the biasing action of an expansion spring 94 and the slide 91 being slightly shiftable longitudinally of the assembly 14.

The hand grip 16 is removably secured to the trigger guard 96 for the gun 10 as at 98 and the trigger 100 is pivoted from the assembly 14 by a pin and slot connection as at 102 and the trigger is under the biasing action of a compression spring 104.

With attention now invited more specifically to FIG. 2, a rear cap 106 is threaded in the counterbore 40 and has a threaded bore 108 formed in its rear end, the forward end of the threaded bore 108 terminating in a smooth counterbore 110 opening through the front side of the cap. An externally threaded velocity adjuster sleeve 112 is partially threaded into the threaded bore 108 and includes a smooth bore 114 therethrough which slidably receives the rear end of a hammer rod 116 therethrough equipped with a cocking knob 118 removably threadedly engaged on the rear end thereof. The forward end of the velocity adjuster sleeve 112 includes a diametrically enlarged head 120 thereon slidable in the counterbore 110 and a compression spring 122 is disposed about the hammer rod 116 forward of the head 20 and is slidably received through a spacer sleeve 124 disposed in the rear portion of the bore 34 forward of the rear cap 106, the forward end of the hammer rod 116 being removably threaded in a threaded blind bore 126 formed in the rear end of the hammer 78. The adjuster sleeve 112 is locked in adjusted positions within the rear cap by a set screw 126 which may have a seal (not shown) secured thereover to prevent unauthorized adjustment of the adjuster sleeve 112 in the field, the entire assembly 78, 112,116, 118, 120, 122, 124 and 126 being removable as a unit from the rear of the bore 36 upon removal of connecting pin 80 and rear cap 106.

A cylindrical chamber sizer 128 is removably threaded on the forward end of an adjusting rod 130 disposed in the forward end of the bore 36 comprising the second expansion chamber 34 and is equipped with an O-ring 131, the chamber sizer 128 being threaded engaged in the threaded counterbore 38 and the forward end of the counterbore 38 being closed by an end plug 132. The rear end of the adjusting rod 130 is slightly spaced forward of a seal cup 138 disposed within the chamber 34 and threaded on the forward end of a cup rod 140. A compression spring 142 is disposed about the rear end of the adjusting rod 30 forward of a pair of adjusting nuts 144 threaded on the adjusting rod 130. The front end of the compression spring 142 bears against the rear end of the rear adjusting nut 144 and the rear of the spring 142 bears against the front side of the seal locator 134 which is generally circular in plan shape but includes four generally semicircular cutouts spaced about its periphery.

Figure 4:
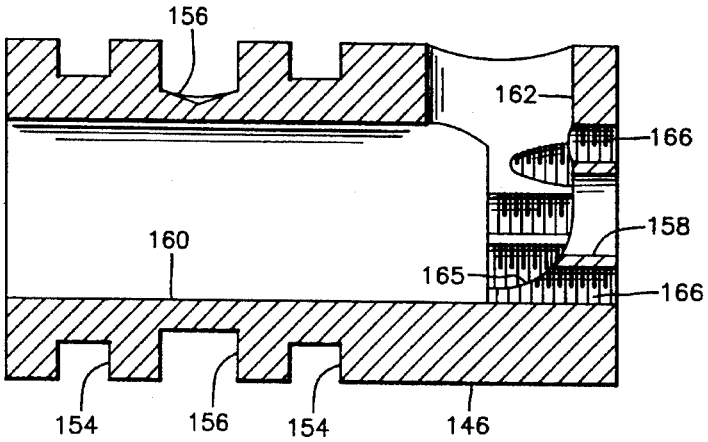
FIG. 4 is an enlarged longitudinal vertical sectional view of the valve tube through which gas under pressure passes to the bolt cavity upon opening of the cup valve.
Figure 5:
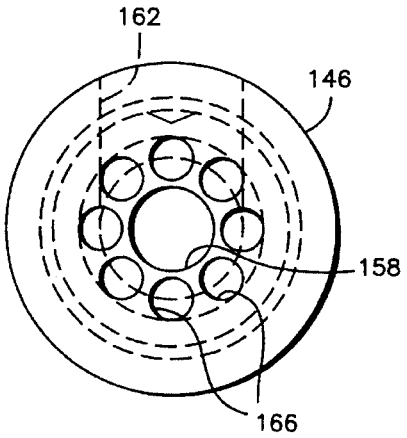
FIG. 5 is a right end elevational view of the valve tube illustrated in FIG. 4.

A generally cylindrical valve 146 is fixed in position within the bore 36 through the utilization of a pair of upper and lower set screws 148 and 150. From FIGS. 4 and 5 of the drawings it may be seen that the valve 146 includes a pair of O-ring seal receiving grooves 154 and a pair of diametrically opposite recess portions 156 for receiving the set or lock screws 148 and 150. In addition, the cylindrical valve 146 includes a central bore 158 formed therethrough through which the cup rod 140 is slidably received, the bore 158 including a forward diametrically enlarged counterbore 160 whose forward end is closed by the seal cup 138. In addition, the rear end of the counterbore 160 includes an upwardly directed exhaust port 162 communicated therewith which in turn opens into a transfer passage 164 opening upwardly into the bore 42, the intersection of the counterbore 160 and exhaust port 162 being radiused as at 165 in order to offer as little resistance as possible to the upward movement of $CO_2$ gas into exhaust port 162. Further, the rear end of the valve 146 includes eight circumferentially spaced vent ports 166 formed therein opening rearwardly outwardly of the valve 146 and forwardly into the counterbore 160.

The forward end of the bolt 76 includes a blind bore 170 formed therein opening through the forward end of the bolt 76 through a diametrically enlarged counterbore 172 and rear portion of the blind bore 170 includes a downwardly directed intake port 174 which is registered with the transfer port 164 when the bolt 76 is in its forwardmost position, the forward extremity of the bolt 76 being operative to engage a paint ball 62 seated in the land 56 and to displace that paint ball 62 forwardly into the rear end of the barrel 64 and the closed end of the blind bore 170 extending between 0.450 and 0.700 inch rearward of the intake port 174.

The assembly 14 is held within an appropriate recess provided therefore within the lower portion of the body or frame 12 through the utilization of fasteners 180 and the assembly 14 includes upper and lower components 182 and 184 removably secured together through the utilization of fasteners 186 and fastener 187 secure the hand grip 16 to the assembly 14.

In operation, the cartridge 22 is threaded into position upon the hand grip 16, one or more paint balls or projectiles 62 are downwardly displaced into the intake tube 58 of the magazine 48 and the lowermost projectile or paint ball 62 seats in the land 56, this all assuming that the knob 118 has been pulled rearwardly to the position thereof illustrated in FIG. 1 with the rear end 88 of the sear or cam 90 projecting upwardly into the rear portion of the notch 86, thus retaining the cylindrical hammer 78 in its rearmost position illustrated in FIG. 1 and with the bolt 76 similarly rearwardly displaced to its rearmost position by its connection to the hammer 78 via the connecting pin 80.

The pretensioning of the spring 142 may be accomplished by adjusting the lock nuts 144 and, thereafter, adjustment of the size of the expansion chamber 34 may be carried out by adjusting the chamber sizer 128 after removing the end plug 132. Further, the pretensioning of the spring 122 may be accomplished by adjustment of the adjuster sleeve 112. After the sleeve 112 has been adjusted, it is locked in adjusted position relative to the rear cap 106 through the utilization of the set screw 126.

In operation, once the nipple 20 of the cartridge 22 has been threaded into the cavity 18 and the seal on the cartridge 22 has been punctured, $CO_2$ gas is discharged from the cartridge 22 and is first expanded into the chamber 24. Then, as the trigger 100 is pulled rearwardly, the slide 91 is shifted slightly forwardly while at the same time the sear or cam 90 is angularly displaced in a clockwise direction as viewed in FIG. 1 in order to downwardly retract the rear end 88 of the cam 90 from the notch 86, these positions of the trigger 100 and sear or cam 40 being illustrated in FIG. 2. At this point, the spring 122 drives the hammer rod 108 and the hammer 78 forwardly in the bore 34 and the forward end of the hammer 78 abuts against the rear end of the cup rod 140 to thereby forwardly displace the seal cup 138 from the forward end of the valve 146, the once expanded $CO_2$ gas within the chamber 34 and the transfer passage 28 having been expanded for the second time in the second expansion chamber 34 and passing into the counterbore 168 behind the forwardly displaced seal cup 138. Thereafter, the $CO_2$ under pressure passes through the exhaust port 162, into the inlet port 174 and thereafter into the blind bore 170 in which the $CO_2$ gas is expanded for the third time. The three times expanded $CO_2$ gas is then discharge forwardly through the counterbore 172 at the forward end of the bolt 76 and propels the projectile or paint ball 62 seated in the rear end of the barrel 64 forwardly through the latter.

Of course, as the hammer 78 was forwardly displaced under the biasing action of the spring 122, the bolt 76 was also forwardly displaced from the rearmost position thereof illustrated in FIG. 1 to the forwardmost position thereof illustrated in FIG. 3 to forwardly displace the paint ball or projectile 62 seated in the land 56 into the rear end of the barrel 64.

As the first charge of $CO_2$ passes through the valve 146 on its way to the blind bore 170 and counterbore 172, a portion of the $CO_2$ gas under pressure passing rearwardly through the valve 146 is discharged rearwardly therefrom through the vent ports or passages 166 with sufficient pressure buildup between the rear end of the valve 146 and the front end of the hammer 78 to overcome the biasing action of the spring 122 in order to cause the hammer 78 and the bolt 76 to again be rearwardly displaced to the positions thereof illustrated in FIG. 1, the bores each being threaded and selectively removably closable, if desired, by the threading of a headed screw (not shown) in each bore 166 to be closed. The seer or cam 12, under the biasing action of the spring 94, then being operative to swing upwardly into the notch 86 in order to retain both the hammer 78 and the bolt 76 in their rearmost positions illustrated in FIG. 1. As the bolt 76 is retracted, the next projectile or paint ball 62 passing downwardly through the inlet tube 58 is positioned in the land 56 and the entire firing process again may be carried out upon immediate rearward displacement of the trigger 100. This action may be rapidly repeated as long as paint balls or projectiles 62 are supplied to the upwardly and outwardly opening inlet tube 58 and until the supply of liquid $CO_2$ within the cartridge 22 is exhausted.

By increasing the tension on the spring 122, the hammer 78 drives the cup rod 40 a greater distance forward from the valve 146 and thus the seal cup 138 remains open for a slightly longer period of time. This increases the amount of $CO_2$ gas under pressure which passes through the valve and is available not only to increase the velocity of the projectile or paint ball 62 projected forwardly through the barrel, but also the amount of $CO_2$ gas under pressure which will pass rearwardly through the vent ports 166 in order to drive the hammer 78 and the bolt 76 back to their rearmost positions illustrated in FIG. 1. Also, adjustment of the nuts 144 may be carried out to adjust the tension of the spring 142 which opposes the action of the forwardly moving hammer 78 on the cup rod 140. Still further, adjustment of the chamber sizer 128 is carried out to adjust the volume of the second expansion chamber 134 and thus the amount of $CO_2$ under pressure therein available to pass rearwardly and upwardly from the valve 146. Thus, there are at least three adjustments which may be carried out that effect the muzzle velocity of a projectile or paint ball 62 being projected forwardly through the bore 66.

The process of three times expanding the $CO_2$ gas in the first expansion chamber 24, the second expansion chamber 34 and the third expansion chamber defined by the blind bore 170 and the counterbore 172 is very important inasmuch as the absorption of heat by the expansion of gas in each of these chambers, when the gun 10 is not fired in rapid succession, allows ambient heat to rewarm the chilled $CO_2$ in each of the expansion chambers and to thereby obtain a greater propulsive force from each quantity of $CO_2$ discharged from the cartridge 22 into the gun 10. Furthermore, the utilization of two expansion chambers 24 and 34 before the $CO_2$ gas passes through the valve 146 ensures that there will be substantially no liquid $CO_2$ within the second expansion chamber 34 to cause any problems with movement of the various internal components of the gun 10.

Further, by placing the first expansion chamber 24 within the hand grip 16 and constructing the hand grip 16 of reasonably good heat transfer material, all but rapid firing of the gun 10 will result in the first expanded $CO_2$ gas within the chamber 24 being more quickly warmed by the heat of the hand in which the hand grip 16 is supported.

Also, it is to be noted that the rear portion of blind bore 170 extends between 0.450 and 0.700 inch rearward of the intake port 174. This "backboring" and the quantity of $CO_2$ gas received therein increases the muzzle velocity of the paint ball 62.

The foregoing is considered as illustrative only of the principles of the invention. Further, since numerous modifications and changes readily will occur to those skilled in the art, it is not desired to limit the invention to the exact construction and operation shown and described, and accordingly, all suitable modifications and equivalents may be resorted to, falling within the scope of the invention.

What is claimed as new is as follows:

1. A gun including a frame, a barrel assembly supported from said frame having front and rear ends and defining a bore, a projectile magazine comprising a rear portion of said assembly and defining a rearward extension of said bore, said magazine opening upwardly and outwardly to one side of said barrel, a bolt reciprocally supported from said frame for movement in said bore between forward and rear positions registered with and retracted rearwardly relative to said magazine, respectively, and operative to shift a projectile in said rearward extension of said bore forwardly into said bore upon forward movement from said rear position to said forward position, said bolt and frame including projection means for providing gas under pressure forward of said bolt and behind said projectile responsive to said forward movement, said frame and magazine including coacting means removably supporting said magazine from said frame for front-to-rear reversed support therefrom whereby said magazine may be mounted to open upwardly and outwardly to either side of said barrel.

2. The gun of claim 1 wherein the rear end of said barrel assembly is telescopically mounted in a forwardly opening portion of said frame and projects slightly rearwardly into said rearward extension of said bore, whereby said barrel assembly must be forwardly shifted relative to said frame forward portion before said magazine may be reverse mounted from said frame.

3. The gun of claim 2 wherein the rear end of said barrel assembly is removably threadedly mounted in said forwardly opening portion of said frame.

4. The gun of claim 1 including bolt biasing means yieldingly biasing said bolt forwardly relative to said frame in said projectile bore, the underside of said frame including a trigger mechanism removably supported therefrom incorporating upper and lower components shiftably supporting coacting sear and trigger members, respectively, therefrom, said trigger member and sear member each being shiftable between cocked and firing positions, trigger member and sear member biasing means yieldingly biasing said trigger member and sear member towards said cocked positions, first fastener means removably securing said upper and lower components together and second fastener means removably anchoring said lower component to said frame, said sear member being operative to automatically releasably retain said bolt in said cocked position upon rearward movement of said bolt to said rear position, said trigger member being operative to shift said sear member to the firing position thereof for release of said bolt and forward movement of said bolt under the biasing action of said bolt biasing means to the firing position thereof upon movement of said trigger member from its cocked position to its firing position.

5. The gun of claim 4 wherein said trigger member biasing means is connected between said trigger member and said upper component and said sear member biasing means is connected between said sear member and said lower component.

6. A gun including a frame, a barrel assembly supported from said frame having front and rear ends and defining a bore, a projectile magazine comprising a rear portion of said assembly and defining a rearward extension of said bore, said magazine opening upwardly and outwardly to one side of said barrel, said frame and magazine including coacting means removably supporting said magazine from said frame for selected front-to-rear reversed support of said magazine from said frame whereby said magazine may be mounted to open upwardly and outwardly to either side of said barrel, and projection means operative to provide gas under pressure within said rearward extension of said barrel.

7. The gun of claim 6 wherein the rear end of said barrel assembly is telescopically mounted in a forwardly opening portion of said frame and projects slightly rearwardly into said rearward extension of said bore, whereby said barrel must be forwardly displaced relative to said frame portion before said magazine may be reverse mounted from said frame.

8. The gun of claim 7 wherein the rear end of said barrel assembly is removably threadedly mounted in said forwardly opening portion of said frame.

9. In a paint ball gun of the type including a barrel assembly defining a projectile bore therein having an open front end and a closed rear end, said barrel assembly including an upwardly opening notch forward of the rear end thereof, a front-to-rear reversible gravity feed magazine removably mounted within said notch for upward removal therefrom and including a projectile receiving bore formed therethrough registered with said projectile bore intermediate its opposite ends, a bolt slidable within said projectile bore rearwardly of said magazine and projectable through said projectile receiving bore for forwardly displacing a projectile in said projectile receiving bore into said projectile bore forward of said notch, and means operative to introduce gas under pressure between said bolt and a projectile in said projectile bore when said bolt is forwardly positioned to displace said projectile forwardly into said projectile bore from said projectile receiving bore.

10. The gun of claim 7 including a frame from which said barrel assembly is removably supported, said projectile receiving bore including opposite end counterbores, said barrel assembly including a barrel member forwardly removable from said frame, defining said projectile bore forward of said magazine and including a rear terminal end received in the corresponding counterbore.

11. The gun of claim 10 wherein said gravity feed magazine includes an upwardly and laterally outwardly inclined inlet tube, whereby when said magazine is reversed in front-to-rear position said inlet tube will open upwardly and outwardly to opposite sides of said barrel assembly.

12. The gun of claim 11 wherein said frame includes an elongated upper sight rib carried by the upper central portion of said frame rearwardly of said notch and magazine and the lateral inclination of said inlet tube positions the latter to opposite sides of said sight rib when said magazine is in either of said front-to-rear reverse positions.

13. A gun including a frame, a barrel assembly supported from said frame having front and rear ends and defining a bore, a projectile magazine comprising a rear portion of said assembly and defining a rearward extension of said bore, said magazine opening upwardly and outwardly to one side of said barrel, a bolt reciprocally supported from said frame for movement in said bore between forward and rear positions registered with and retracted rearwardly relative to said magazine, respectively, and operative to shift a projectile in said rearward extension of said bore forwardly into said bore upon forward movement from said rear position to said forward position, said bolt and frame including projection means for providing gas under pressure forward of said bolt and behind said projectile responsive to said forward movement, said frame including a second bore formed longitudinally therethrough having front and rear end portions defining expansion and hammer chambers, respectively, a generally cylindrical hammer reciprocal in said rear portion, expansion chamber sizing means disposed in said front end portion and valve means mounted in said second bore intermediate said front and rear end portions, said expansion chamber comprising a portion of said projection means, said valve means comprising control means intermediate said expansion chamber and said rearward extension of said bore, said sizing means removably closing the forward extremity of said front end portion and being adjustably operable through the forward extremity of said second bore to vary the effective volume of said expansion chamber.

14. The gun of claim 13 wherein said second bore is disposed beneath said projectile bore, a transfer passage communicating said projectile and second bores, said valve means including a cylindrical valve body stationary in said second bore and having through gas passage means formed longitudinally therethrough and also lateral gas exhaust port means communicating said through gas passage means with said intake port, a valve member disposed in said second bore forward of said valve body and forwardly and rearwardly shiftable in said second bore to open and close, respectively, said through gas passage means, means yieldingly biasing said valve member rearwardly in said second bore, said valve member being carried by the forward end of an elongated rod disposed lengthwise in said second bore and lengthwise reciprocal through said valve body, means yieldingly biasing said hammer forwardly in said second bore, said hammer, upon forward movement in said second bore, being engageable with the rear end of said elongated rod to displace said rod and said valve member forwardly to thereby open said through gas passage means.

15. The gun of claim 14 wherein said means yieldingly biasing said valve member rearwardly in said second bore includes means operative to adjust the biasing force thereof on said valve member.

16. The gun of claim 14 wherein said means yieldingly biasing said hammer forwardly in said second bore includes means operative to adjust the biasing force thereof on said hammer.

17. The gun of claim 16 wherein said means yieldingly biasing said hammer forwardly in said second bore and said hammer removably close the rear end of said second bore and are removable, as a unit, from the rear end of said second bore.

18. The gun of claim 14 wherein said valve member, expansion chamber sizing means and means yieldingly biasing said valve member rearwardly in said second bore close the forward end thereof and are removable, as a unit, from the front end of said second bore.

19. The gun of claim 14 wherein the outside corner of the inner section of said through gas passage means and said lateral gas exhaust port means is radiused to thereby minimize resistance to gas flow from said through gas passage means into said lateral gas exhaust port means.

20. The gun of claim 14 wherein said bolt includes front and rear ends and a blind longitudinal bore formed therein opening end wise outwardly through said front end, said bolt also including an upstanding lateral intake port formed therein opening upwardly into said blind bore forward of the rear extremity thereof and downwardly laterally outwardly of said bolt in a location thereon registered with said transfer passage when said bolt is in said forward firing position, said lateral intake port opening upwardly into said blind bore between 0.450 and 0.700 inch forward of the rear extremity of said blind bore.

21. An elongated cylindrical bolt for reciprocal movement between front and rear firing and cocked positions, respectively, within the rear portion of a projectile bore of a gas powered gun of the type including a gas transfer passage opening laterally into said bore from a valved supply of gas under pressure, said bolt including a blind longitudinal bore formed therein opening forwardly and endwise outwardly through said front end and a lateral intake port formed therein opening into said blind bore forward of the rear end thereof at a first end of said intake port and laterally outwardly of said bolt at a second end of said intake port at a location for registry with said transfer passage when said bolt is in said forward position, said intake port opening into said blind bore at a location spaced between 0.450 and 0.700 inch forward of the rear extremity of said blind bore.

* * * * *